US009011274B1

(12) United States Patent
Fox, Jr.

(10) Patent No.: US 9,011,274 B1
(45) Date of Patent: Apr. 21, 2015

(54) FOX SHARPSHOOTER PUTTER GRIP

(71) Applicant: Andrew Criddle Fox, Jr., Amory, MS (US)

(72) Inventor: Andrew Criddle Fox, Jr., Amory, MS (US)

( * ) Notice: Subject to any disclaimer, the term of this patent is extended or adjusted under 35 U.S.C. 154(b) by 0 days.

(21) Appl. No.: 14/095,125

(22) Filed: Dec. 3, 2013

Related U.S. Application Data

(63) Continuation-in-part of application No. 12/931,083, filed on Jan. 25, 2011, now abandoned.

(51) Int. Cl.
*A63B 57/00* (2006.01)
*A63B 53/14* (2006.01)
*A63B 69/36* (2006.01)

(52) U.S. Cl.
CPC ..... *A63B 53/14* (2013.01); *A63B 69/36* (2013.01); *A63B 2220/18* (2013.01); *A63B 2220/20* (2013.01)

(58) Field of Classification Search
CPC .... A63B 53/14; A63B 69/36; A63B 2220/18; A63B 2220/20
USPC ..... 473/282, 407, 709, 300, 241
See application file for complete search history.

(56) References Cited

U.S. PATENT DOCUMENTS

| | | | | |
|---|---|---|---|---|
| 2,519,727 | A * | 8/1950 | Yezdan | 33/277 |
| 3,824,698 | A * | 7/1974 | Brucker | 33/277 |
| 4,927,151 | A * | 5/1990 | Ronnick | 473/241 |
| 5,094,452 | A * | 3/1992 | Hennigan | 473/212 |
| 5,330,179 | A * | 7/1994 | Hampel | 473/404 |
| 6,405,442 | B1 * | 6/2002 | Ratcliff | 33/1 SD |
| 6,636,296 | B1 * | 10/2003 | Faulkner et al. | 356/21 |
| 6,770,000 | B2 * | 8/2004 | Shelley | 473/404 |
| 7,419,438 | B2 * | 9/2008 | Koiwai | 473/226 |
| 7,828,670 | B1 * | 11/2010 | Schroader | 473/285 |
| 7,860,673 | B2 * | 12/2010 | Harel | 702/68 |
| 2002/0169030 | A1 * | 11/2002 | Chun-Sheng | 473/286 |
| 2003/0083142 | A1 * | 5/2003 | Nam | 473/286 |
| 2005/0043120 | A1 * | 2/2005 | Garza | 473/404 |

FOREIGN PATENT DOCUMENTS

JP 03242161 A * 10/1991 ..... A63B 53/00

* cited by examiner

*Primary Examiner* — Stephen Blau

(57) ABSTRACT

The Fox Sharpshooter putter grip is a putter grip that has two unique features. First it contains a chart to help the golfer to determine the how hard to strike the golf ball when putting. Second it features a cap containing a bubble level to help the golfer to hold the putter shaft vertically, which will give the golfer a consistent vertical line with which to compare to the slope of the green. This will help the golfer to determine which direction the ball will roll (the break.) When the chart and the bubble level are used together, they help the golfer to "read" a putt with great accuracy. The Fox Sharpshooter putter grip conforms to USGA rules when the cap with the bubble level is removed.

7 Claims, 5 Drawing Sheets

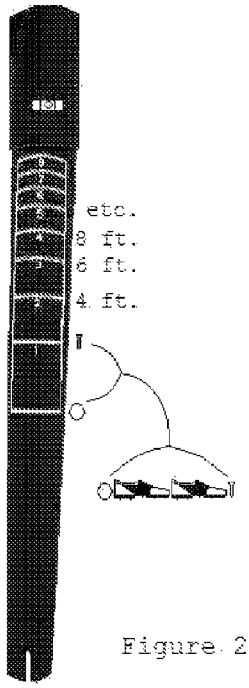
Figure 2
Figure 3.
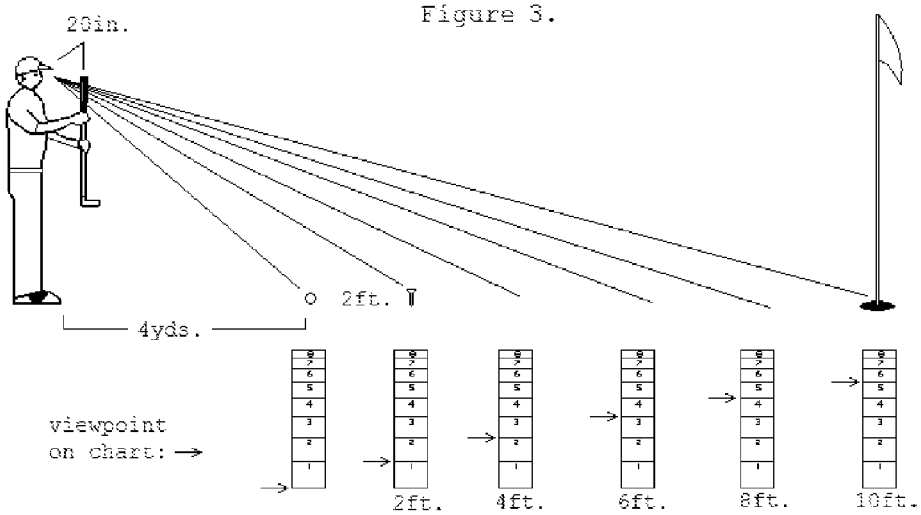

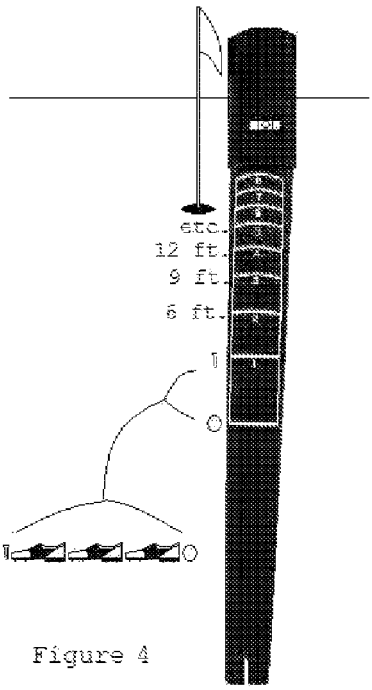
Figure 4
Figure 5.
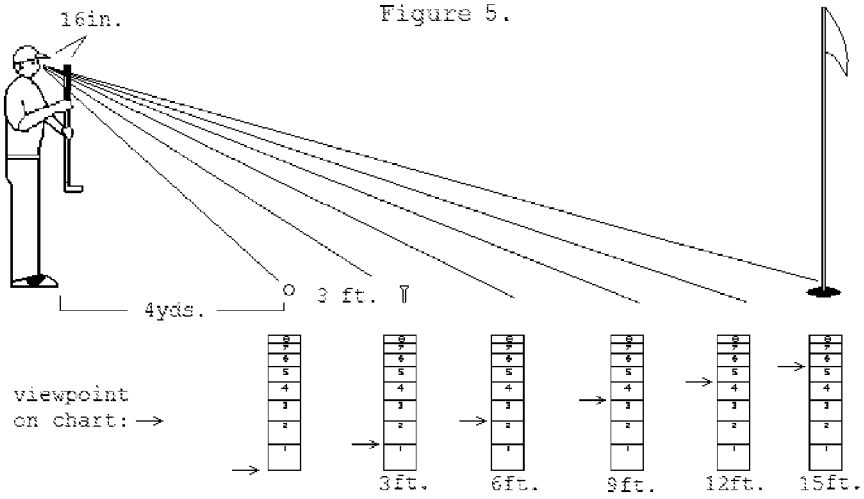

FOX SHARPSHOOTER PUTTER GRIP

This is a continuation in part of U.S. application Ser. No. 12/931,083, with a filing date of Jan. 25, 2011. Mr. Stephen Blau, examiner

BACKGROUND OF THE INVENTION

The Fox Sharpshooter putter grip is a golf putter grip that has two features; 1) a chart, and 2) a cap for the putter grip that contains a bubble level. Used together, these features will enable a golfer to read the green and putt with greater accuracy.

The chart helps the golfer to obtain a quick estimate of the distance of the putt so the golfer will know how hard to strike the putt. The bubble level turns the putter grip and the shaft into a vertical reference point with which to compare to the slope of the green. This enables the golfer to know where to aim the putt. Together these features enable a golfer to read the green and putt accurately.

BRIEF SUMMARY OF THE INVENTION

The Fox Sharpshooter putter grip has two features that make it different from other putter grips. It has a chart that helps a golfer to determine how much force to strike a putt of that length. It also has a cap which fits onto the top of the putter grip that contains a bubble level whose longitudinal axis is perpendicular to the putter grip. The golfer can use the bubble level to set the putter grip and it's chart at vertical position from the horizon. The golfer can use the vertical reference to compare with the slope of the green. From that view the golfer can find an aiming point for the putt. Used together these features give a golfer the best chance for a successful putt. The mission statement of the Fox Sharpshooter putter grip is: More sunk putts, more tap in two putts, and eliminate three putts.

BRIEF DESCRIPTION OF THE SEVERAL VIEWS OF THE DRAWING

FIG. 2 depicts how the chart is used to accurately estimate the length of a putt. If a golfer places a tee in the ground two steps past the ball toward the target (app. 2 feet), and stands four yards behind the ball away from the target, holding the putter grip 20 inches from his or her dominant eye, and the golfer sets the bottom rung of the chart adjacent to the ball and the second rung of the chart adjacent to the tee, then multiples of the two foot distance are shown by the rungs on the chart; (4 ft., 6 ft., 8 ft., etc.,) enabling the golfer to assess the distance from the ball to the target (hole.) To find the distance from the ball to the target (hole) the golfer should multiply the number on the chart of the rung that is horizontally aligned with the hole to the number of feet between the bottom two rungs of the chart when the ball is aligned with the bottom rung. FIG. 2 shows this from the golfer's perspective.

FIG. 3 shows the same as FIG. 2 except from a side view.

FIG. 4 shows the same as FIG. 2 except that the ball and the tee are three feet apart, and the chart on the putter grip is held 16 inches from the eye instead of 20 inches. This enables the golfer to estimate longer putts using the 3 ft. intervals shown on the chart.

FIG. 5 shows the same as FIG. 4 from a side view.

DETAILED DESCRIPTION OF THE INVENTION

Figure 1:
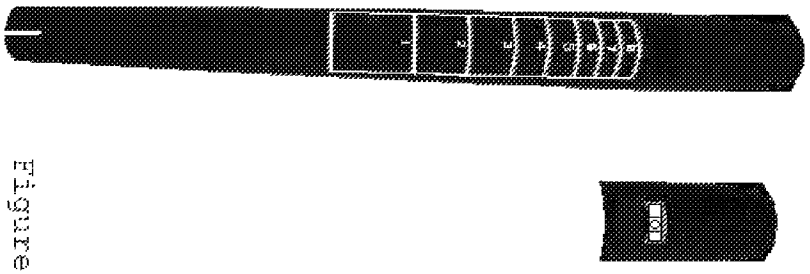
FIG. 1 is a drawing of the back of the two parts of the Fox Sharpshooter putter grip; the golf putter grip with the chart, and the cap which contains a bubble level.
Figure 6:
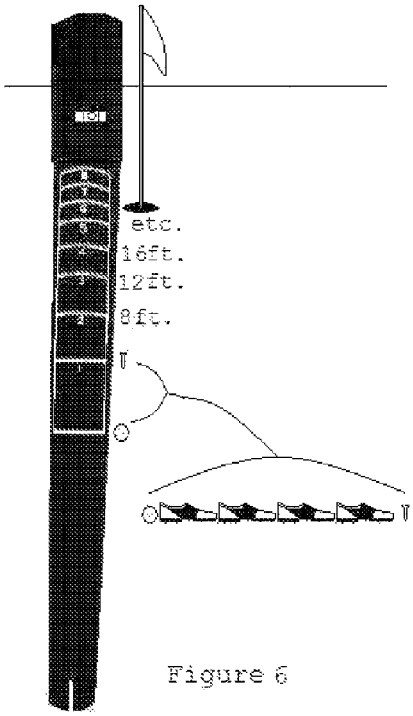
FIG. 6 shows the same as FIG. 2 and FIG. 4 except that the ball and the tee are four feet apart, and the chart on the putter grip is held 12 inches from the dominant eye. This enables the golfer to estimate longer putts using the 4 ft. intervals shown on the chart.
Figure 7:
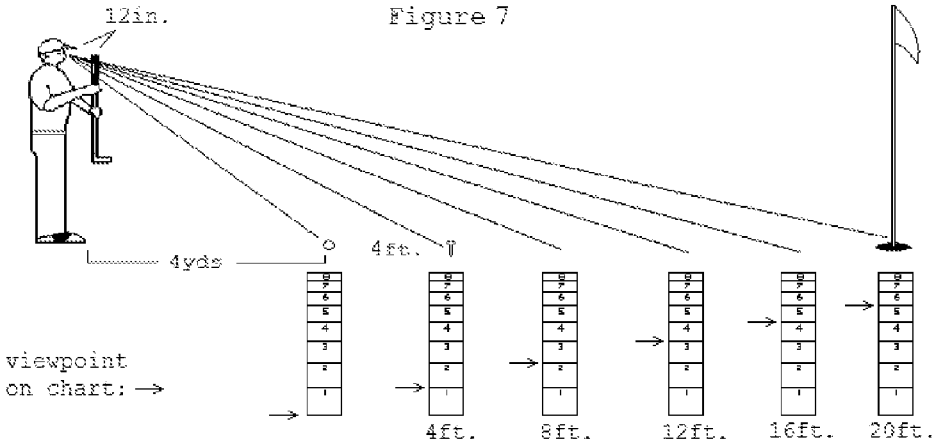
FIG. 7 shows the same as FIG. 6 from a side view.

The Fox Sharpshooter putter grip is a polymer putter handle that is 10.75 inches long, 1.25 inches wide at the top, and 0.75 inches wide at the bottom. It is made using injection molding. There are two features of the grip which make it unique.

First, there is a chart on the back of the grip which helps a golfer to measure the distance of a putt. When a golfer sets the ball adjacent to the bottom rung of the ladder shaped chart and sets the second rung at a certain distance from the ball, the other rungs will show multiples of that distance. For example: if the ball is set adjacent to the first rung, and the second rung is set 2 feet past the ball, the other rungs will show 4 ft., 6 ft., 8 ft., etc. . . . . Or if the $2^{nd}$ rung is set at 3 feet, the other rungs will show 6 ft., 9 ft., 12 ft., etc. This is illustrated in FIGS. 2, 3, 4, 5, 6, and 7, of the drawings. The distance from the ball to the hole can be found by multiplying the number on the rung of the chart adjacent to the hole by the number of feet between the first two rungs. The golfer can use the distance shown on the chart to know how hard to putt the ball. However, the distance shown on the chart will be inaccurate if the putt has an uphill or downhill slope, but the force needed to roll the ball the correct distance will remain consistent with the chart regardless of the distance of the putt.

The ladder shaped chart is indented into the putter grip on the back and painted for excellent visibility. The nine rungs of the chart are fixed at the following length from the bottom of the grip; 4¼", 5⅜", 6⅛", 6¾", 7⅛", 7½", 7¾", 8", and 8¼". The rectangular shaped chart has a length of 4⅛ inches, and a width of 1 inch from top to bottom on the curved grip.

The second unique feature of the Fox Sharpshooter putter grip is a cap that is two inches in length which contains a bubble level. The cap fits on the top of the putter grip. The bubble level is a glass or plastic sealed vial which contains enough liquid that only a bubble remains inside. The bubble moves to the center of the vial when it is perfectly horizontal. The bubble level vial may be from 12 to 20 millimeters long and from 5 to 8 millimeters wide. The vial is inserted into a cavity in the cap which is perpendicular to the cap, and 1.5 inches from the top and on the back side of the cap.

Figure 8:
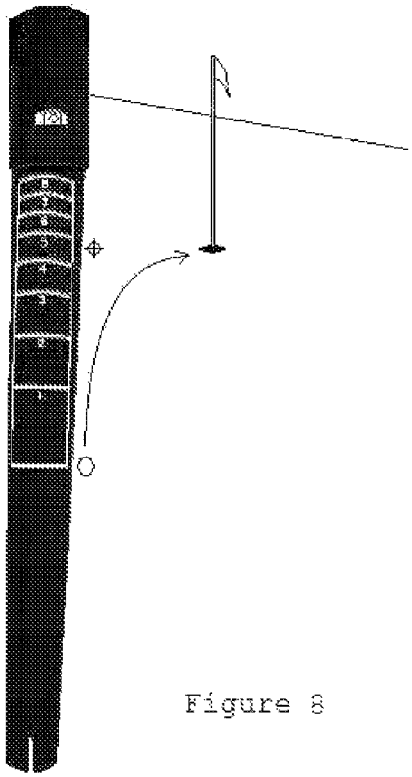
FIG. 8 shows how a golfer can use the bubble level and chart to choose an aiming point for the putt. If the golfer places the downhill side of the grip (right side in FIG. 8) on the ball with his or her dominant eye, and keeps the putter vertical by centering the bubble in the level, and skews the putter grip to the apex of the roll, the golfer will be able to determine that the aiming point is adjacent to the chart at the rung that is horizontally aligned with the target (hole.) The aiming point is designated in FIG. 8 by the crosshair symbol.
Figure 9:
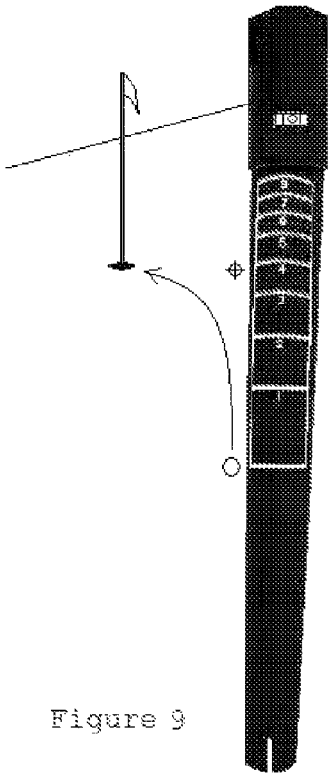
FIG. 9 shows the same as FIG. 8 except the green slopes down to the left.

The bubble level helps the golfer to hold his putter vertically so that he or she can compare it to the slope of the green. This enables the golfer to assess how much the slope will affect the direction of the roll of the ball before it has been putted. Golf greens have different slopes and speeds, but the effect of gravity on the bubble level gives the golfer a consistent line with which to compare to the slope of the green. When a golfer sets the ball adjacent to the down hill side of the chart, then skews the chart from the target (the hole) to the apex of the roll, then aims the putt at the point on the chart adjacent to the target, the putt will be accurate if the ball is putted at the correct speed. This is illustrated in FIG. 8 and FIG. 9.

The United States Golf Association rules that the bubble level is unusual equipment, and therefore does not comply with the USGA rules of golf equipment. The cap may be used on the grip when practicing or any time that the rules are not in play. When the rules do apply the cap can be easily removed.

I claim:

1. A method for putting a golf ball into a target hole comprising the steps of:

providing a putter with a putter grip which has a chart thereon with a cap attached to the top of the grip, wherein the cap contains a bubble level, and wherein the chart has a plurality of rungs;

placing a tee a predetermined distance past a ball towards a hole;

standing a predetermined distance behind the ball away from the hole;

holding the putter grip a predetermined distance from a golfer's eye towards the hole;

setting a bottom rung of the chart adjacent the ball;

setting a second rung of the chart adjacent the tee;

determining the number of rungs from the bottom rung to the rung that is horizontally aligned with the hole;

determining the distance from the ball to the hole by multiplying the determined number or rungs from the bottom rung to the rung that is horizontally aligned with the hole by the distance between the ball and the tee;

determine the slope of the green using the bubble level; and striking a ball towards an aiming point using the determined slope of the green to aim the ball and using the determined distance from the ball to the hole to determine how much force to strike the ball.

2. The method of claim 1 wherein the step of providing the putter includes having the chart with nine rungs with rungs fixed at 4¼ inches, 5⅜ inches, 6⅛ inches, 6¾ inches, 7⅛ inches, 7½ inches, 7¾ inches, 8 inches and 8¼ inches from the bottom of the grip.

3. The method of claim 1 wherein the step of placing the tee the predetermined distance past the ball towards the hole includes placing the tee 2 feet past the ball, and wherein the step of holding the putter grip the predetermined distance from the golfer's eye towards the hole includes holding the grip 20 inches from the golfer's eye.

4. The method of claim 1 wherein the step of placing the tee the predetermined distance past the ball towards the hole includes placing the tee 3 feet past the ball, and wherein the step of holding the putter grip the predetermined distance from the golfer's eye towards the hole includes holding the grip 16 inches from the golfer's eye.

5. The method of claim 1 wherein the step of placing the tee the predetermined distance past the ball towards the hole includes placing the tee 4 feet past the ball, and wherein the step of holding the putter grip the predetermined distance from the golfer's eye towards the hole includes holding the grip 12 inches from the golfer's eye.

6. The method of claim 1 wherein the step of standing the predetermined distance behind the ball away from the hole includes standing 4 yards behind the ball.

7. The method of claim 1 wherein the step of providing the putter includes the bubble level whose longitudinal axis is perpendicular to a longitudinal axis of the putter grip when the cap is attached to the top of the putter grip.

* * * * *